US009939192B2

(12) United States Patent
Yang et al.

(10) Patent No.: US 9,939,192 B2
(45) Date of Patent: Apr. 10, 2018

(54) REFRIGERATOR

(71) Applicant: LG ELECTRONICS INC., Seoul (KR)

(72) Inventors: Changwoan Yang, Seoul (KR); Seungjin Choi, Seoul (KR); Hanhyo Kim, Seoul (KR); Yoomin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/313,598

(22) PCT Filed: Feb. 12, 2016

(86) PCT No.: PCT/KR2016/001423
§ 371 (c)(1),
(2) Date: Nov. 23, 2016

(87) PCT Pub. No.: WO2016/129947
PCT Pub. Date: Aug. 18, 2016

(65) Prior Publication Data

US 2017/0227279 A1 Aug. 10, 2017

(30) Foreign Application Priority Data

Feb. 13, 2015 (KR) ..... 10-2015-0022198

(51) Int. Cl.
*A47B 96/04* (2006.01)
*F25D 25/02* (2006.01)
(Continued)

(52) U.S. Cl.
CPC ..... *F25D 25/024* (2013.01); *F25D 23/028* (2013.01); *F25D 23/062* (2013.01); *F25D 25/025* (2013.01); *F25D 2323/024* (2013.01)

(58) Field of Classification Search
CPC .... F25D 25/024; F25D 25/025; F25D 23/028; F25D 23/062; F25D 2323/024
See application file for complete search history.

(56) References Cited

U.S. PATENT DOCUMENTS 1,835,847 A * 12/1931 Chandler ..... F25D 25/02 126/340
2,095,811 A * 10/1937 Goulooze ..... F25D 25/024 126/337 R
(Continued)

FOREIGN PATENT DOCUMENTS

EP 1607701 12/2005
JP 2004-000403 1/2004
(Continued)

OTHER PUBLICATIONS

International Search Report and Written Opinion in International Application No. PCT/KR2016/001423, dated May 24, 2016.
(Continued)

*Primary Examiner* — Hanh V Tran
(74) *Attorney, Agent, or Firm* — Fish & Richardson P.C.

(57) ABSTRACT

Provided is a refrigerator. The refrigerator includes: a cabinet including an outer case, an inner case disposed inside the outer case and defining a storage space, and an insulating material filled between the outer case and the inner case; a door pivotably connected to a front surface of the cabinet and selectively opening/closing a storage compartment; a shelf assembly including a shelf supporting arm fixed to a real surface of the inner case and a shelf connected to the shelf supporting arm so as to be slidably movable; and a withdrawal device connected to the door and withdrawing the shelf forward in accordance with pivoting of the door for opening the storage space. Here, the withdrawal device includes: a slide member held in a space between the outer case and the inner case; a link member including a front end
(Continued)

portion connected to the door and a rear end portion connected to the slide member; and a connection member connecting the slide member and the shelf.

12 Claims, 16 Drawing Sheets

(51) Int. Cl.
*F25D 23/06* (2006.01)
*F25D 23/02* (2006.01)

(56) References Cited

U.S. PATENT DOCUMENTS 2,761,751 A * 9/1956 Stockton ..... F25D 25/024 312/274
2,926,507 A * 3/1960 Ingolia ..... F25D 17/062 312/23
5,474,374 A * 12/1995 Sandvig ..... A47B 77/18 312/271
6,220,682 B1 4/2001 Vertullo
9,217,602 B2 * 12/2015 Lee ..... F25D 25/02
9,459,040 B2 * 10/2016 Kim ..... F25D 25/02
9,726,423 B1 * 8/2017 Swarnkar ..... F25D 25/024
9,803,915 B2 * 10/2017 Park ..... F25D 25/024
2010/0307186 A1 * 12/2010 Kwon ..... F25D 23/028 62/407
2012/0267993 A1 * 10/2012 Moon ..... F25D 23/067 312/408
2013/0257255 A1 * 10/2013 Hwang ..... F25D 23/02 312/404
2015/0247666 A1 * 9/2015 Kim ..... F25D 23/04 312/404
2017/0227280 A1 * 8/2017 Yang ..... F25D 25/025
2017/0227281 A1 * 8/2017 Yang ..... F25D 25/025
2017/0234607 A1 * 8/2017 Yang ..... A47B 88/453 312/408
2017/0314846 A1 * 11/2017 Yu ..... F25D 25/025

FOREIGN PATENT DOCUMENTS

KR 10-2004-0059041 7/2004
KR 10-2010-0122459 11/2010
KR 10-2010-0130357 12/2010
WO 2011132974 10/2011

OTHER PUBLICATIONS

Extended European Search Report in European Application No. 16749487.1, dated Nov. 8, 2017, 7 pages (with English translation).

* cited by examiner

【Figure 1】
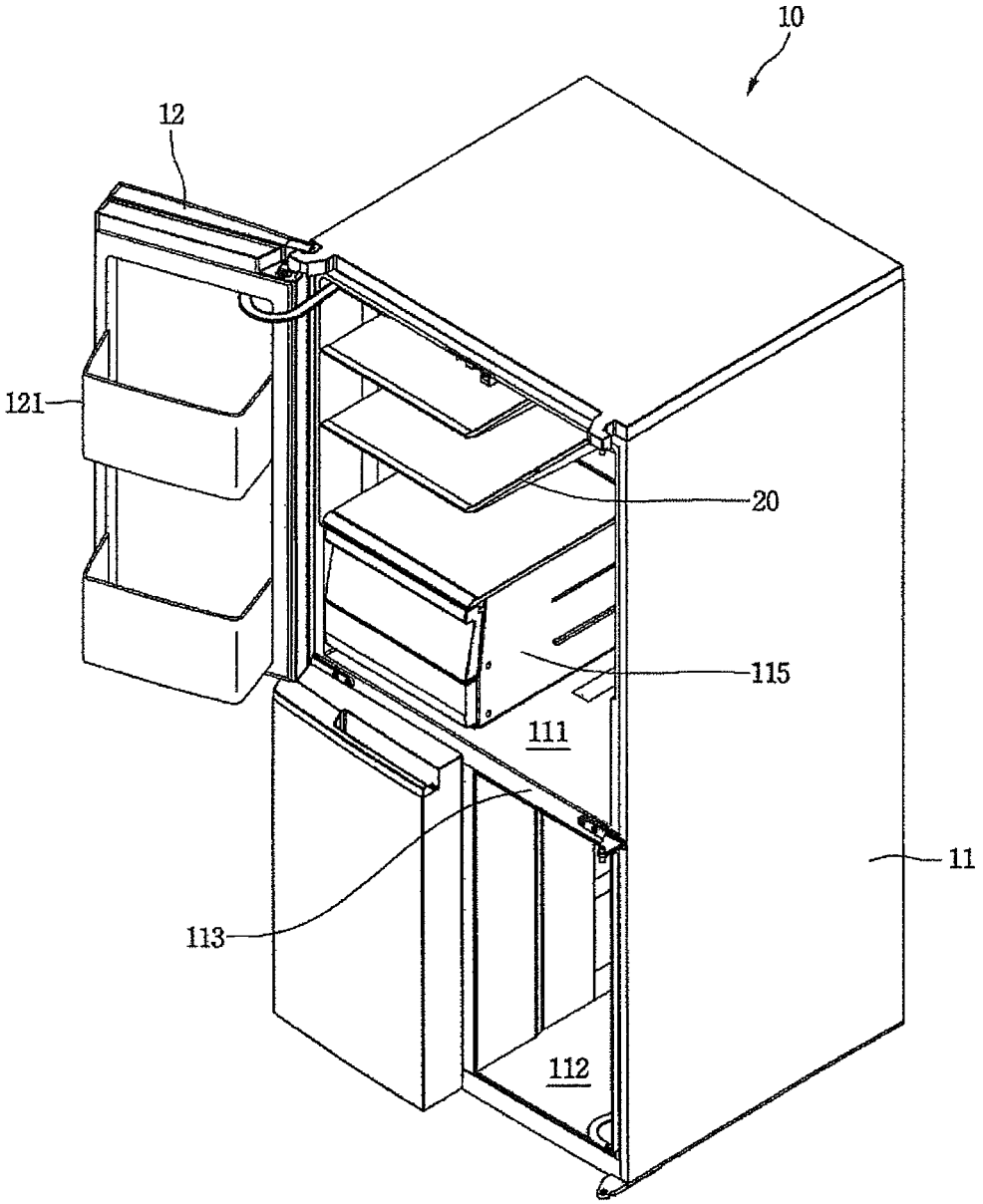

【Figure 2】
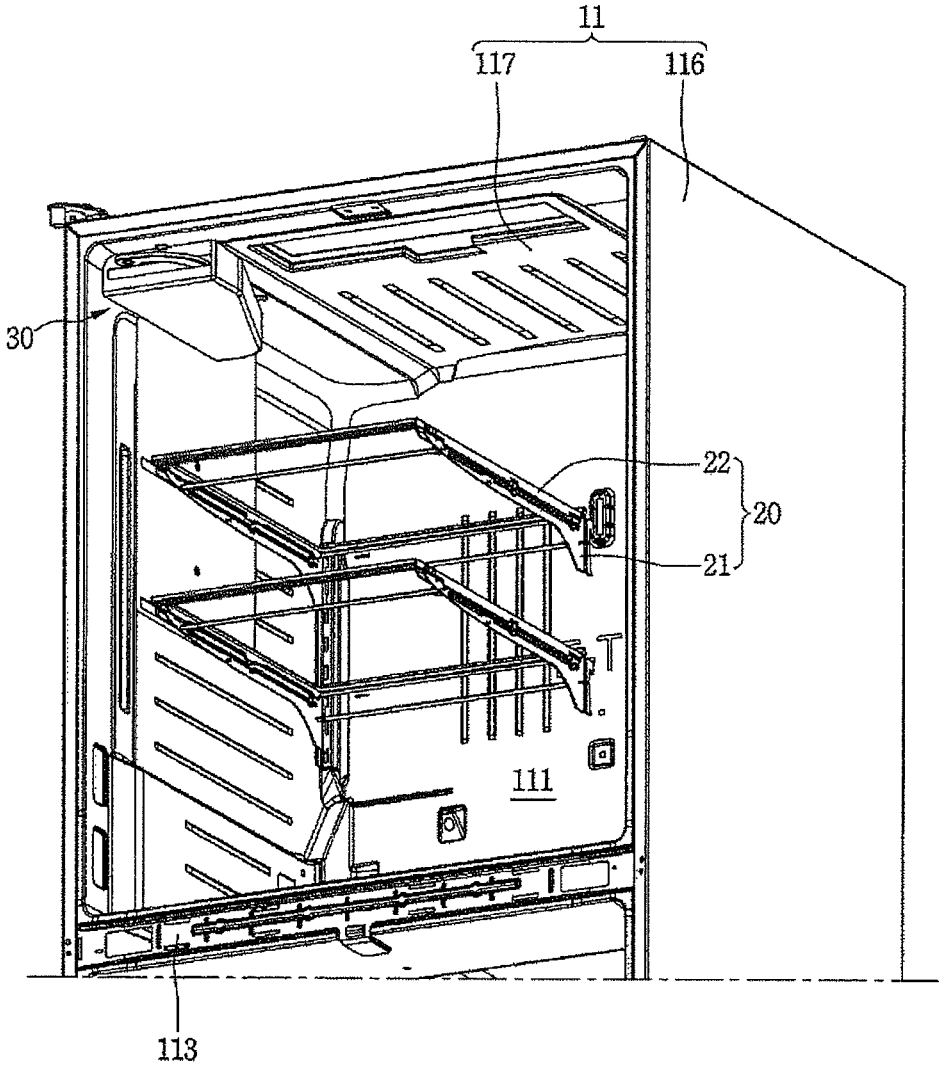

【Figure 3】
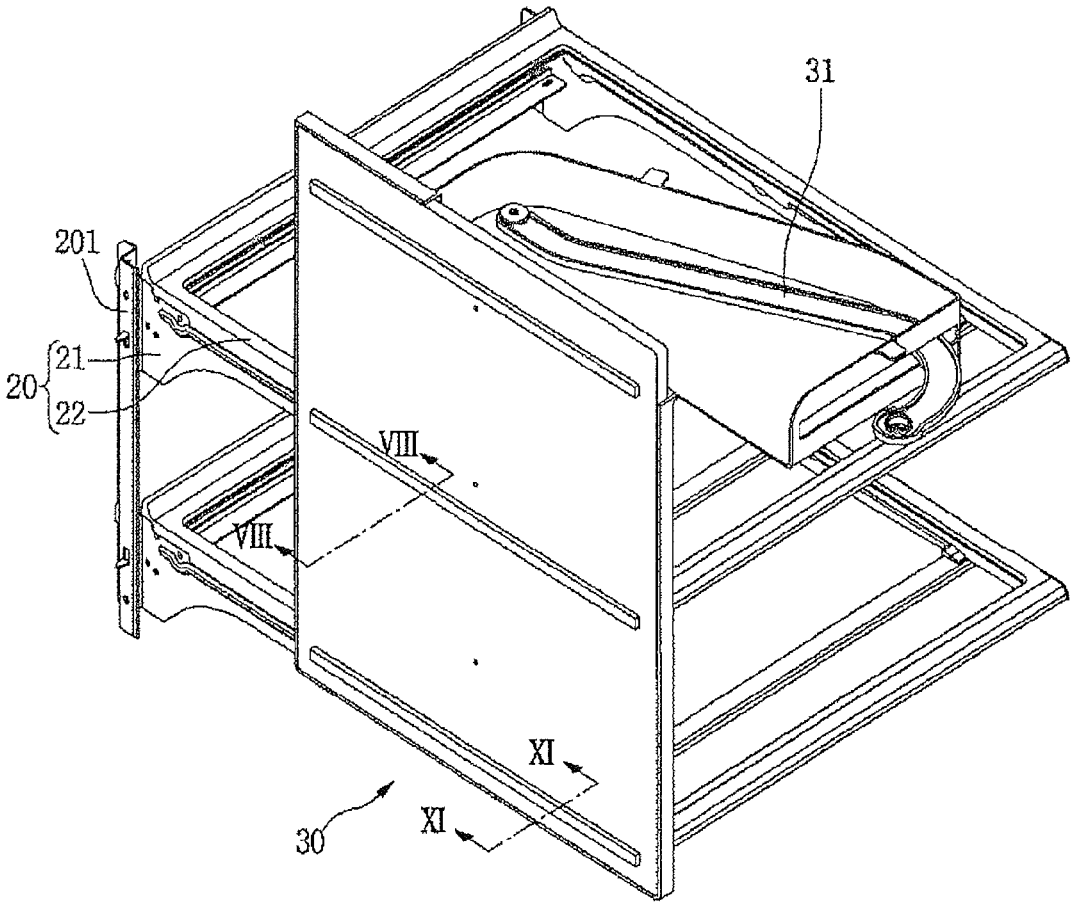

【Figure 4】
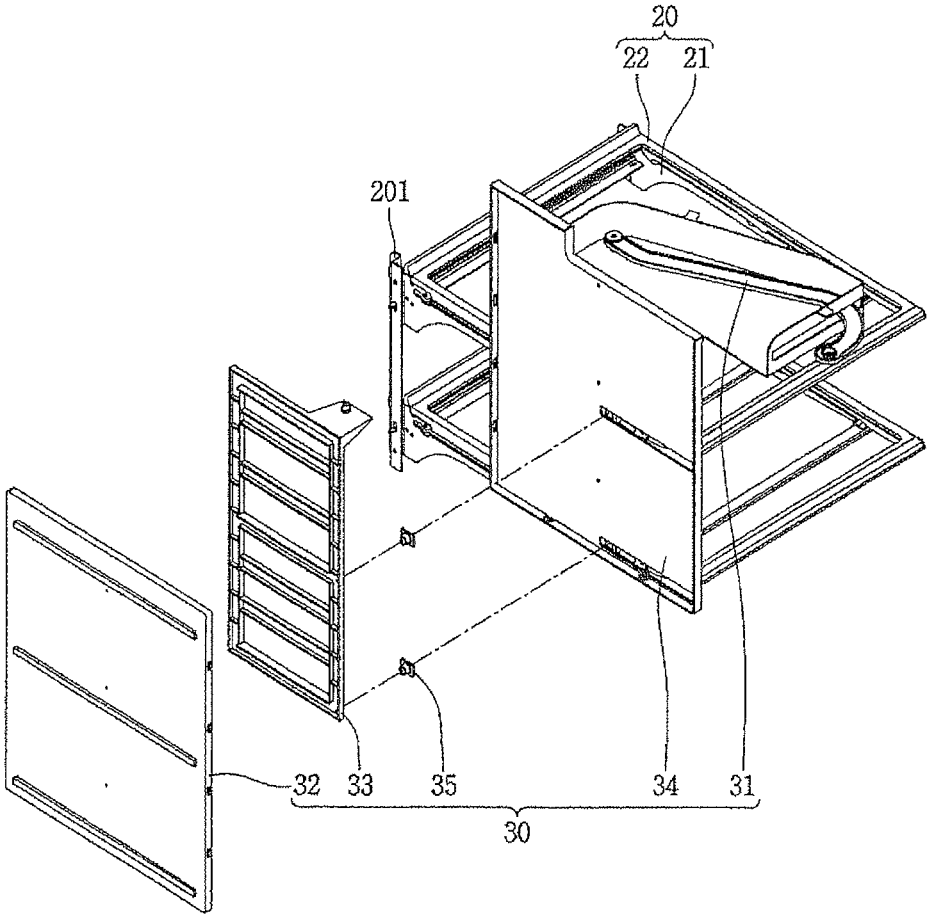

【Figure 5】
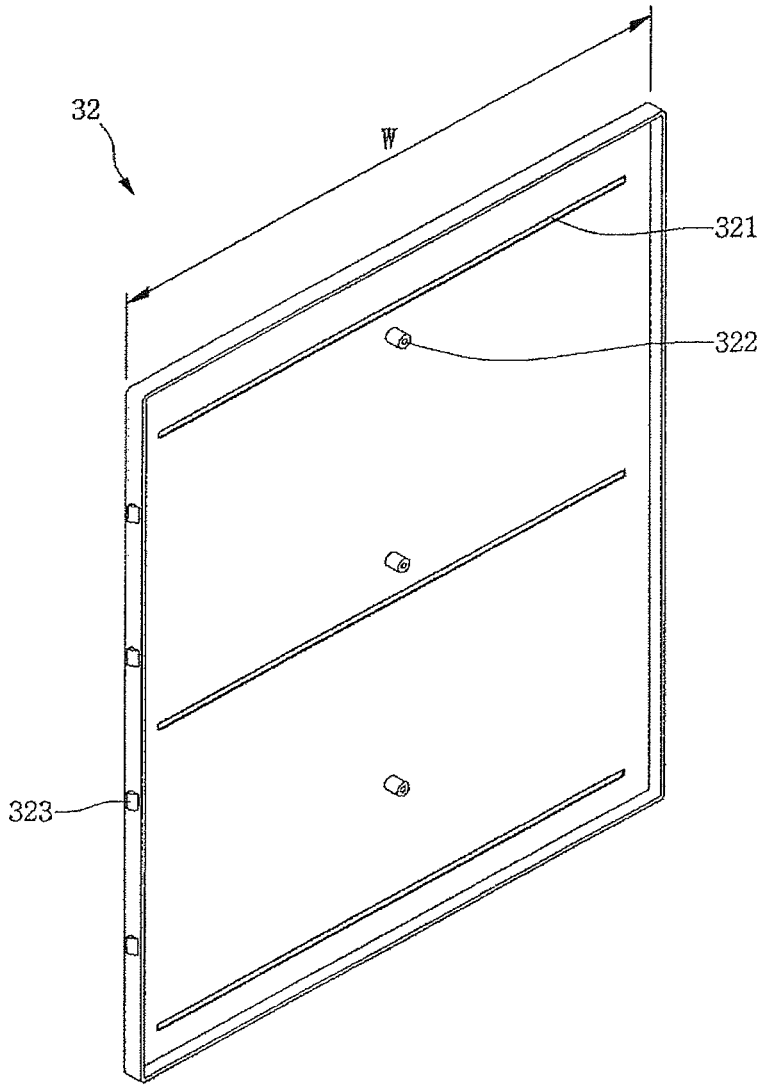

【Figure 6】
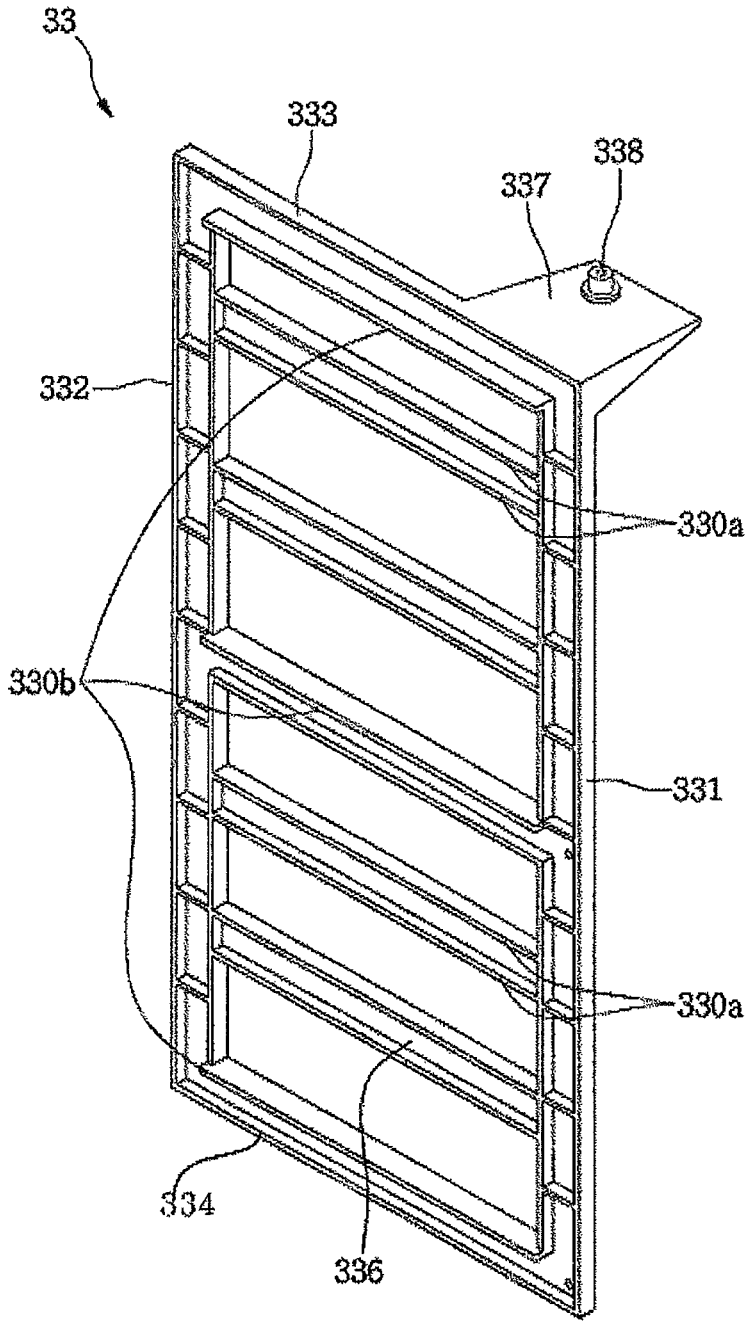

【Figure 7】
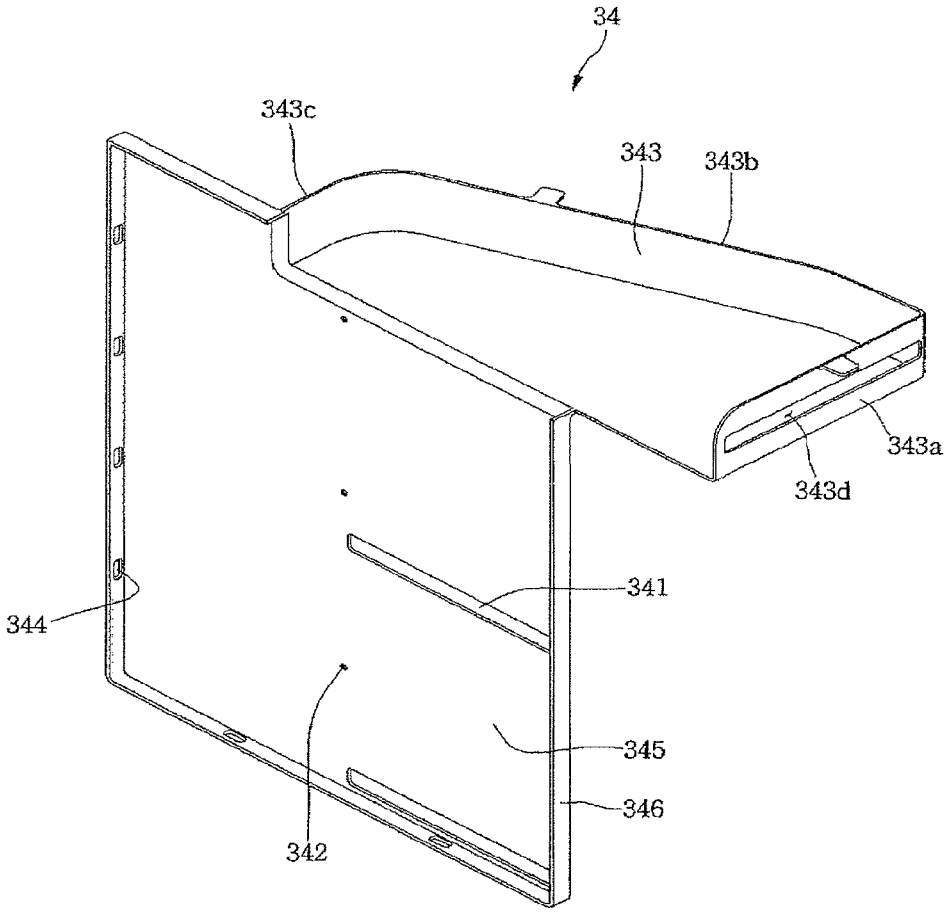

【Figure 8】
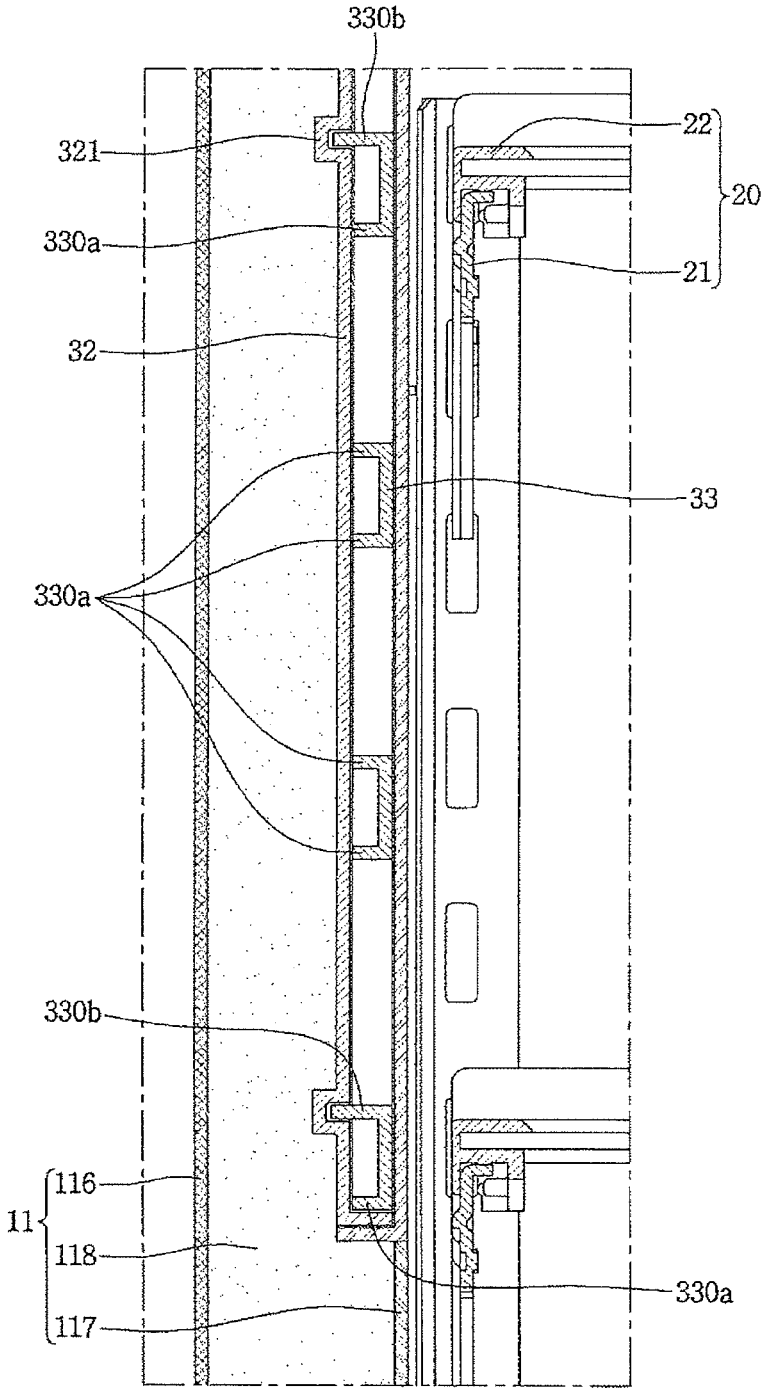

【Figure 9】
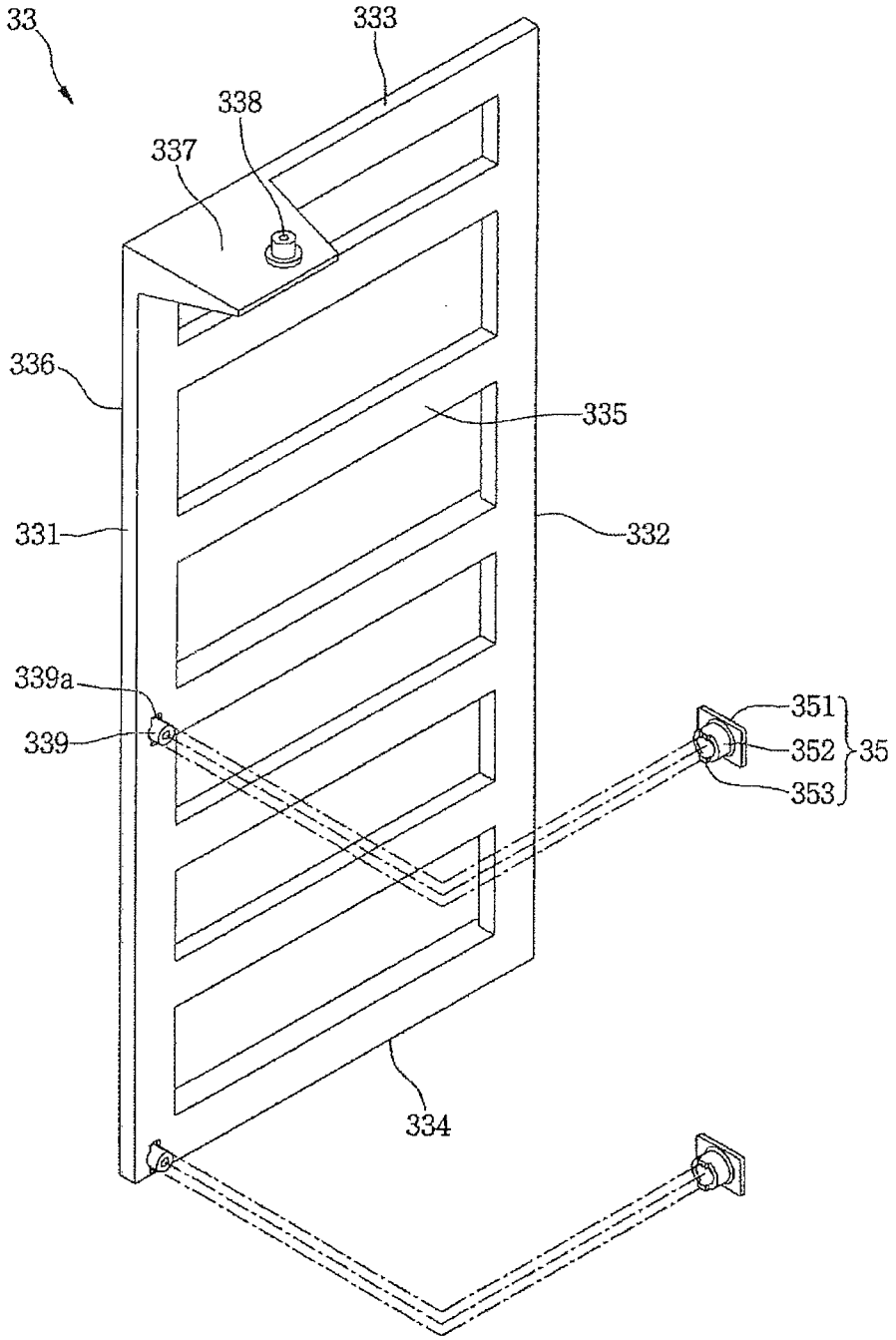

【Figure 10】
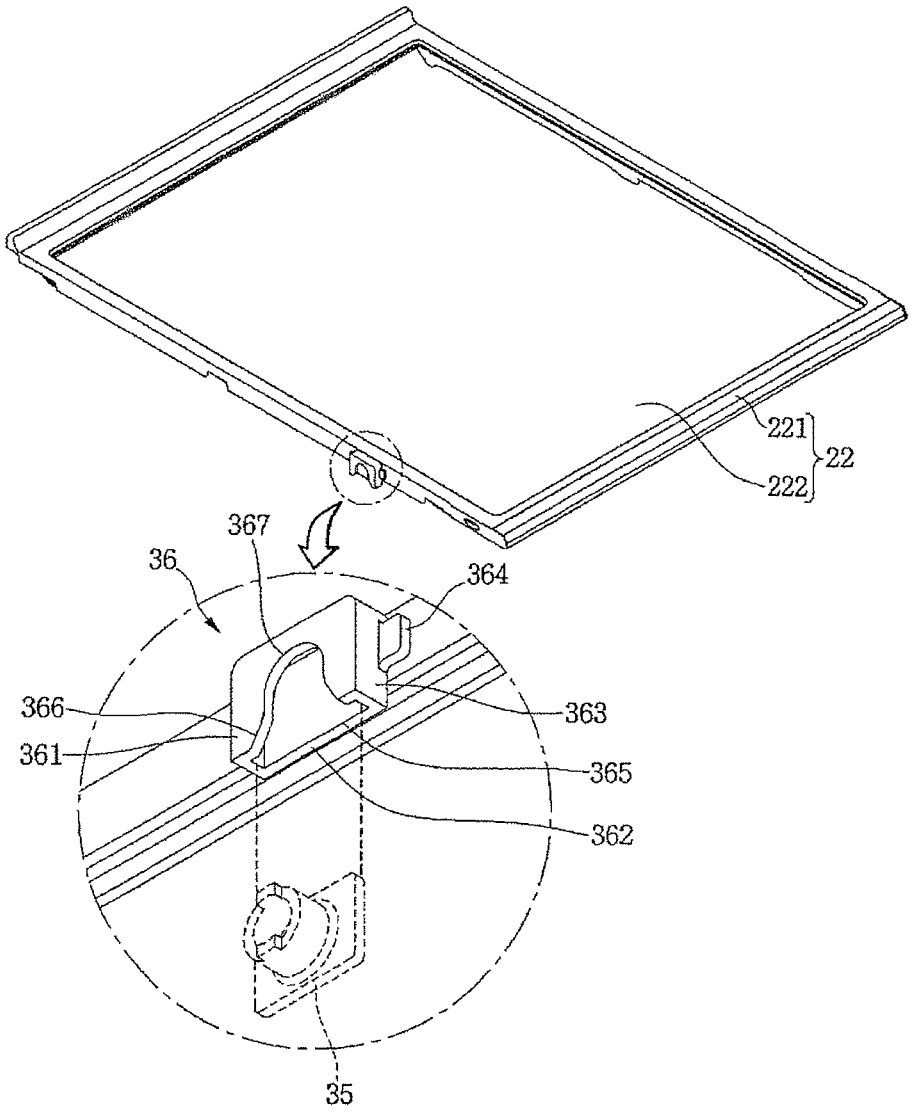

【Figure 11】
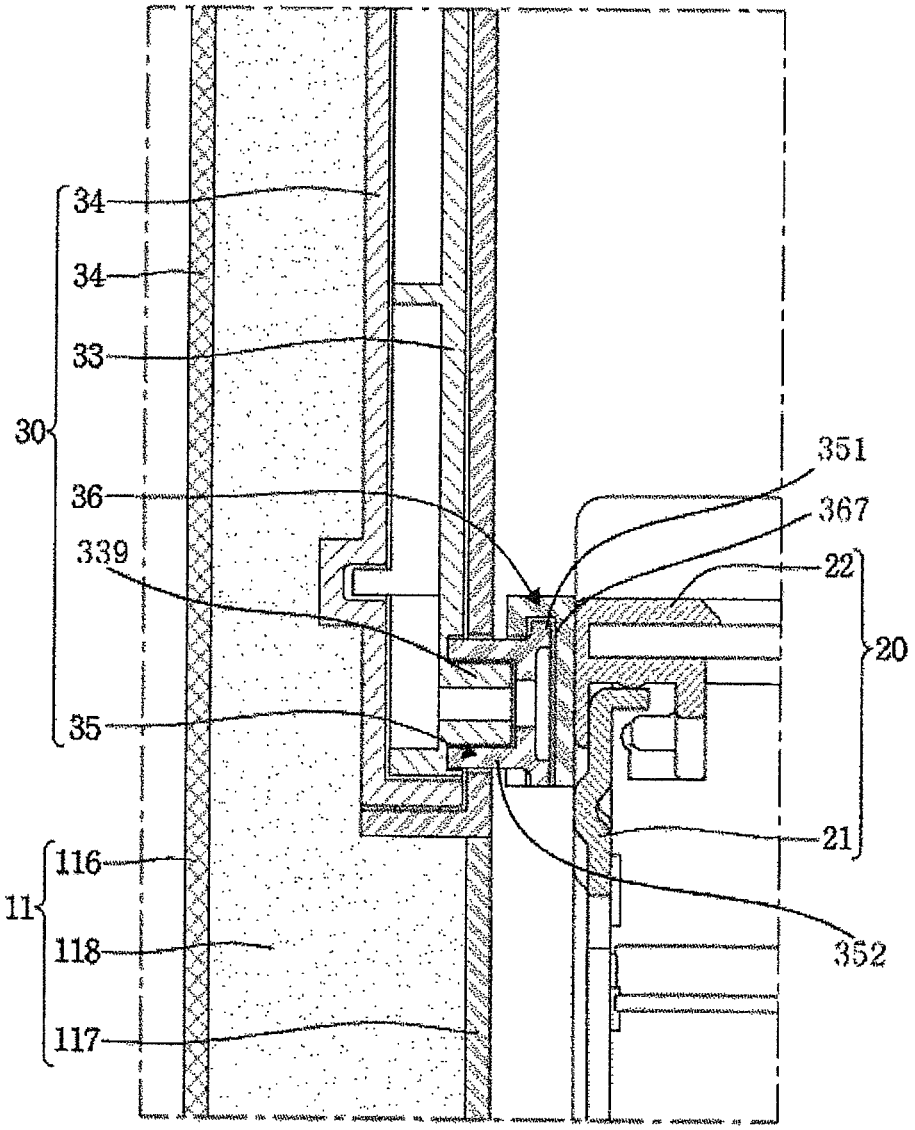

【Figure 12】
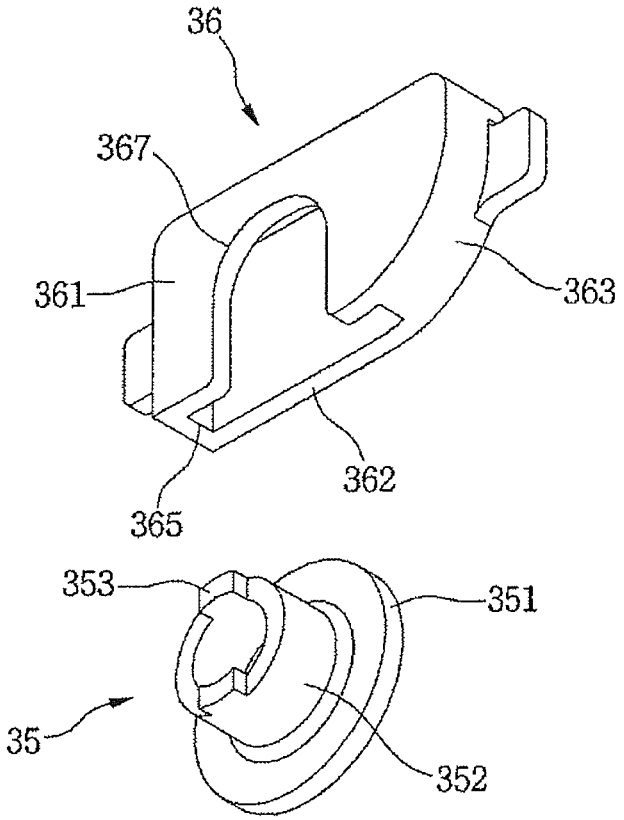

【Figure 13】
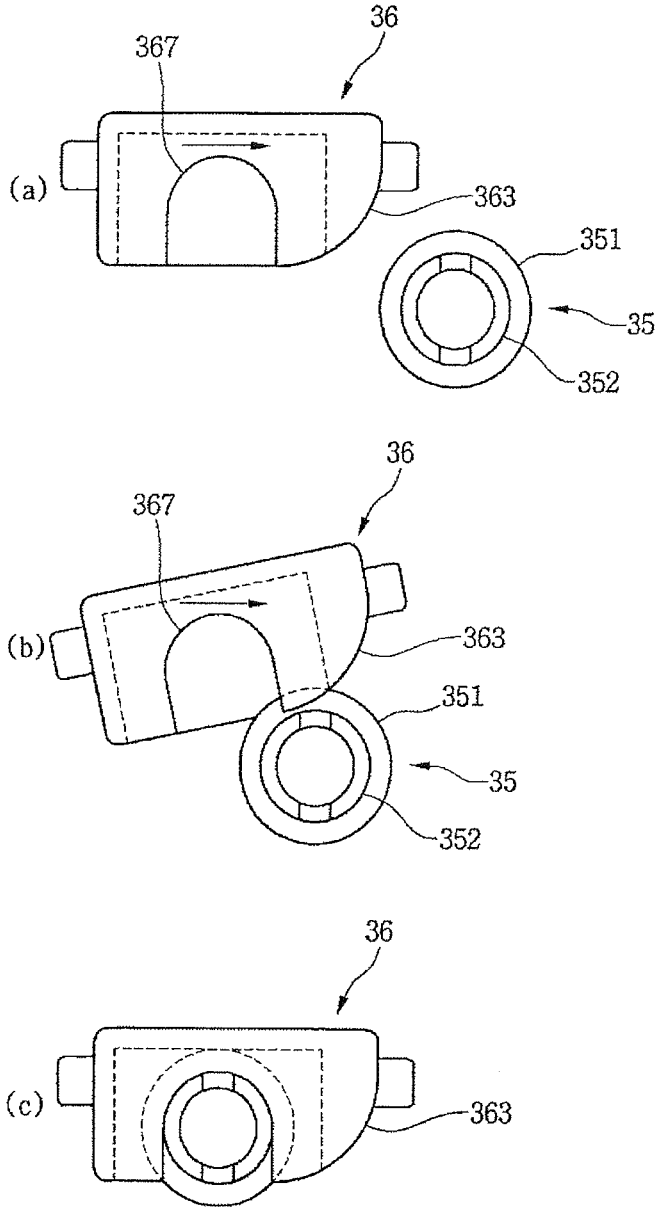

【Figure 14】
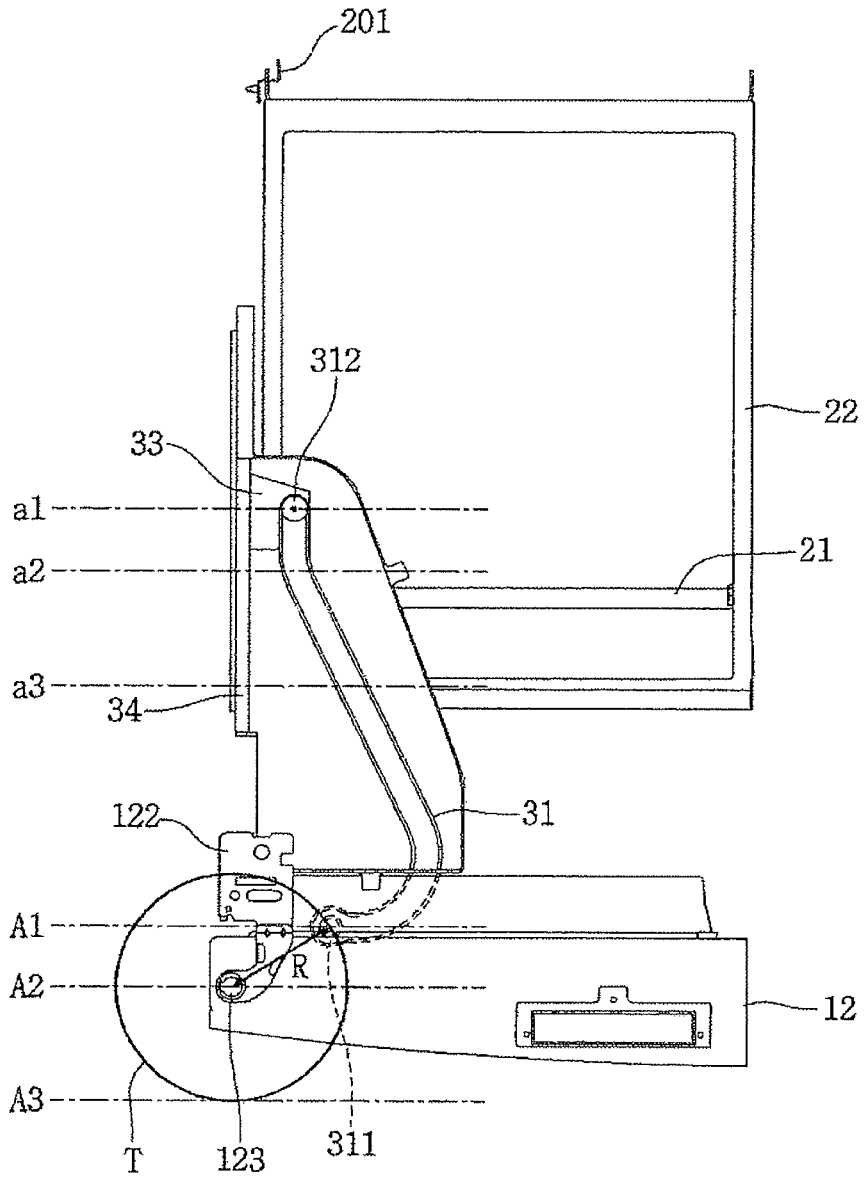

【Figure 15】
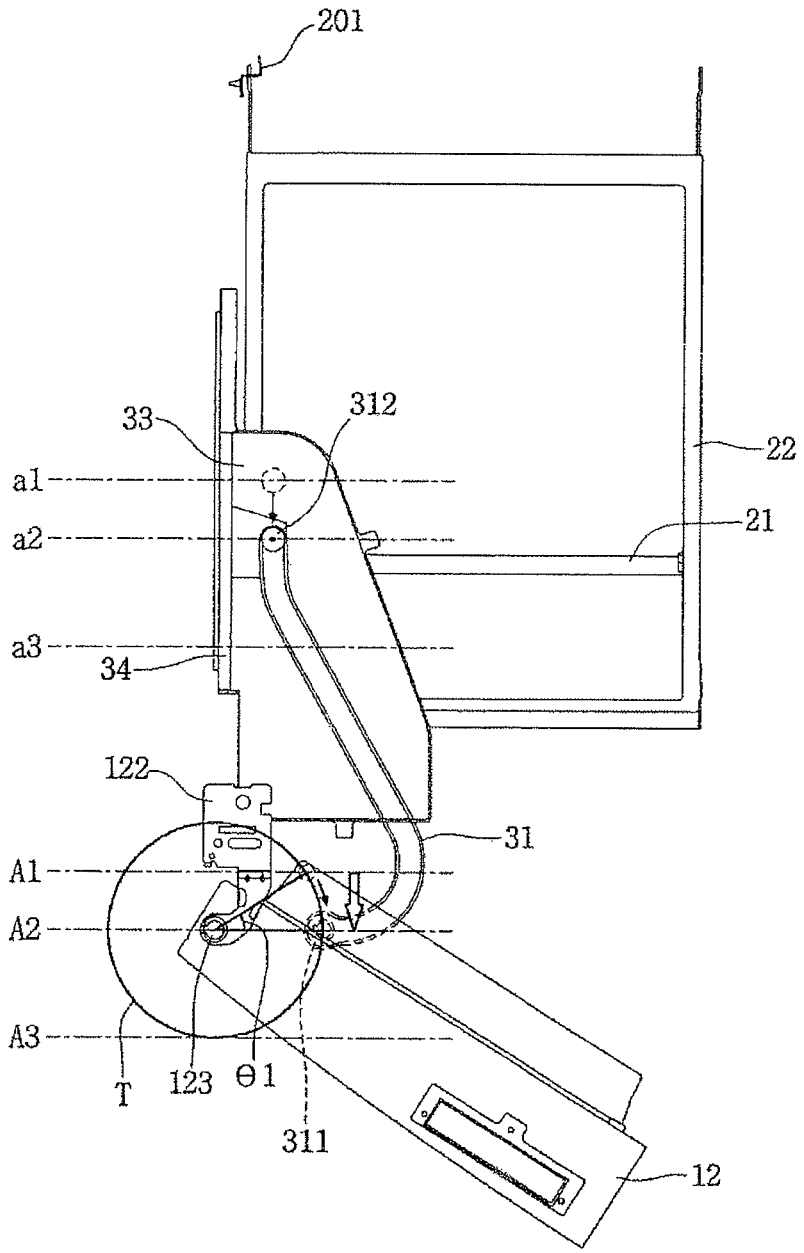

【Figure 16】
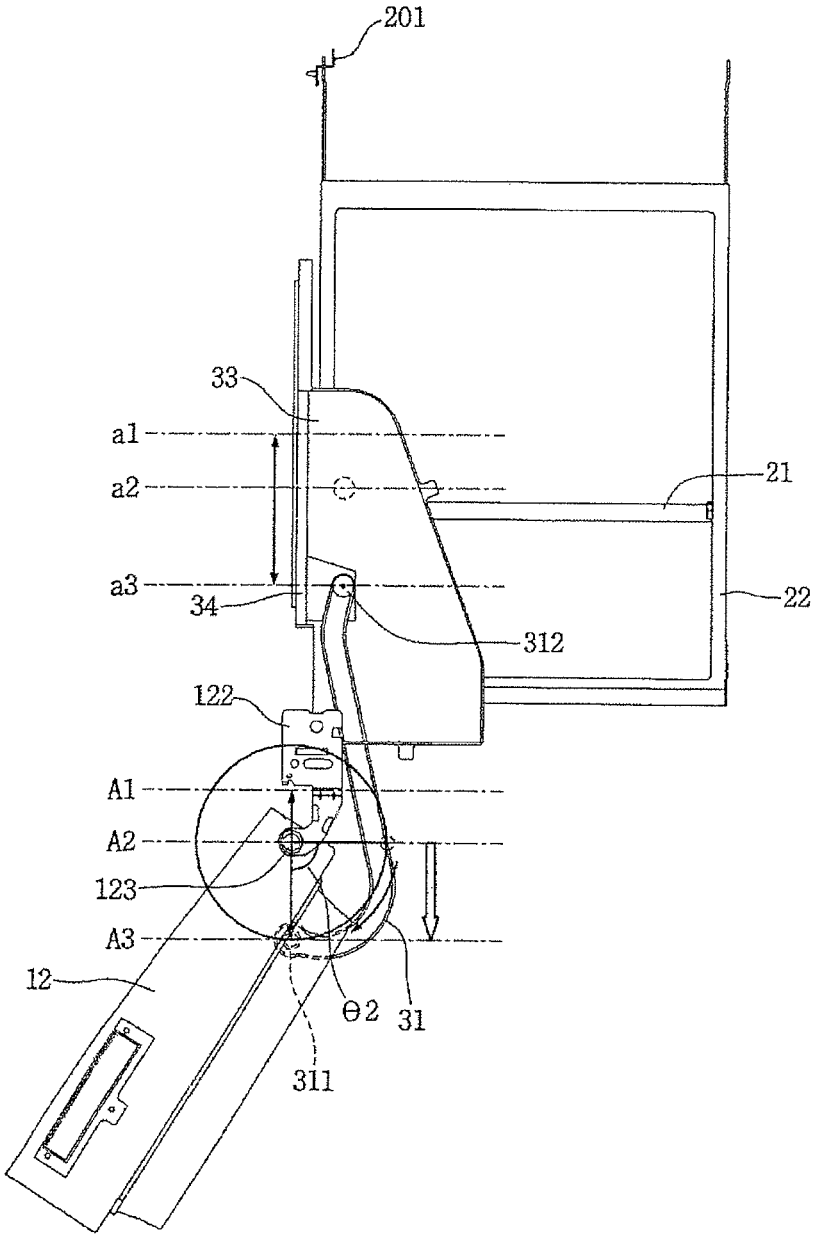

REFRIGERATOR

CROSS REFERENCE TO RELATED APPLICATIONS

This application is a U.S. National Phase Application under 35 U.S.C. § 371 of International Application PCT/KR2016/001423, filed on Feb. 12, 2016, which claims the benefit of Korean Application No. 10-2015-0022198, filed on Feb. 13, 2015, the entire contents of which are hereby incorporated by reference in their entireties.

TECHNICAL FIELD

The present invention relates to a refrigerator.

BACKGROUND ART

A refrigerator is a home appliance that is used to keep food and drink refrigerated or frozen.

Recently, the refrigerator is increasing in size, and devices such as home bar, ice maker, shelf, or door box are being installed onto rear surface of the refrigerator door. In this case, when a refrigerator door is closed, shelves or storage boxes mounted in the storage compartment of the refrigerator body and components mounted on the rear surface of the refrigerator door may interfere with each other.

In order to overcome this interference, the front end portions of the shelves or storage boxes mounted in the storage compartment, i.e., refrigerating compartment or freezing compartment of the refrigerator body are disposed at points spaced away from the front surface of the refrigerator body by a certain distance.

Accordingly, there is inconvenience in that a user needs to dip into the storage compartment to withdraw food and drink stored in the shelves or storage boxes, and it is difficult for a user to check foods stored at the rear side of the storage compartment. This limitation is more significant in a large refrigerator. In case of a large refrigerator, since the horizontal length of the refrigerating compartment or the freezing compartment is larger, it is difficult for a user to withdraw foods deeply stored in the rear end portion of the shelf.

Various methods have been proposed to improve these limitations. Particularly, Korean Patent Application Publication No. 2010-0130357 (Dec. 13, 2010) filed by the present applicant discloses a structure in which a shelf and a storage box installed inside the refrigerating compartment or the freezing compartment are placed on a storage frame and the storage frame is connected to the undersurface of the refrigerator door by a multi joint link Accordingly, when the refrigerator door is rotated and opened, the storage frame moves forward, and the shelf and the storage box move to the front side of the refrigerator.

In this case, the loads of the shelf and the storage box are all delivered to the storage frame. In other words, the storage frame supports all of the loads of the shelf and the storage box and loads of foods stored therein. Accordingly, since a user has to apply a great force to open the refrigerator door, the elderly and infirm, women, and children may feel significantly difficult to open the refrigerator door.

In addition, since the frame structure to withdraw the shelves is exposed to the outside, the inside of the refrigerator may not look neat, and there may be difficulty in cleaning the inside of the refrigerator.

DISCLOSURE

Technical Problem

The present invention has been proposed to overcome the above-mentioned limitations.

Technical Solution

According to an aspect of the present invention, there is provided a refrigerator including: a cabinet including an outer case, an inner case disposed inside the outer case and defining a storage space, and an insulating material filled between the outer case and the inner case; a door pivotably connected to a front surface of the cabinet and selectively opening/closing a storage compartment; a shelf assembly including a shelf supporting arm fixed to a real surface of the inner case and a shelf connected to the shelf supporting arm so as to be slidably movable; and a withdrawal device connected to the door and withdrawing the shelf forward in accordance with pivoting of the door for opening the storage space, wherein the withdrawal device includes: a slide member held in a space between the outer case and the inner case; a link member including a front end portion connected to the door and a rear end portion connected to the slide member; and a connection member connecting the slide member and the shelf.

The connection member may comprise a connector mounted onto the slide member; and a receiver mounted onto a side surface of the shelf and receiving the connector. The inner case may comprise a guide slit formed at a point corresponding to the location of the shelf and extending in forward and backward directions by a certain length, and the connector is coupled to the receiver through the guide slit.

The front end portion of the link member may be located at a point spaced from a rotation axis of the door by a certain distance.

The refrigerator may further comprise a link cover disposed around a ceiling of the inner case to block the link member from being exposed to the inside of the storage compartment.

The refrigerator may further comprise an outer cover disposed between the inner case and the outer case and covering the slide member. The refrigerator may further comprise at least one guide rib protruding from the other surface opposite to one surface of the slide member to which the connector is connected and extending in a width direction of the slide member by a certain length; and a guide groove concavely formed in the outer cover and receiving the guide rib. The refrigerator may further comprise at least one spacing rib disposed at locations vertically spaced from the guide rib and protruding and extending parallelly to the guide rib.

The connector may comprise a connecting sleeve fixed to the slide member and penetrating the guide slit; and a separation preventing plate extending orthogonally to the connecting sleeve from an end portion of the connecting sleeve, wherein the separation preventing plate is inserted into the receiver. The receiver may comprise a first surface portion; a second surface portion which is spaced apart from the first surface portion and provides a receiving space between the first and second surface portions; and a third surface portion connecting the edges of the first and second surface portions, except lower sections of the edges of the first and second surface portions such that an insertion hole for receiving the separation preventing plate is formed on a lower side surface of the receiver, wherein: a fitting groove into which the connecting sleeve is fitted is formed at the first surface portion; and the fitting groove is upwardly recessed from a lower end of the first surface portion. A front surface of the third surface portion which faces a front end of the shelf may be rounded, and the front-to-rear width of the front surface of the third surface portion may gradually decrease from an upper side to a lower side.

The receiver may be detachably coupled to the shelf

The foregoing and other objects, features, aspects and advantages of the present invention will become more apparent from the following detailed description of the present invention when taken in conjunction with the accompanying drawings.

Advantageous Effects

A refrigerator according to an embodiment of the present invention configured as above has the following effects.

First, since the storage box and the shelf are withdrawn while the load of the shelf is dispersed, the refrigerator door can be opened with a relative small force.

Second, since the slide member which withdraws the shelf is disposed inside the cabinet, the slide member is not exposed to the outside even though the refrigerator door is opened.

Third, since the receiver mounted onto the shelf among the connection members connecting the slide member and the shelf is detachably connected to the shelf, it is possible for a user to freely select whether to use the automatic withdrawal function.

Fourth, in the structure of the connection member connecting the slide member and the shelf, since the connector is automatically inserted into the receiver only with an operation of slightly lifting up and putting down the shelf while withdrawing the shelf forward or only with an operation of withdrawing the shelf forward, the assembly convenience can be improved.

DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a perspective view illustrating a refrigerator according to an embodiment of the present invention;

FIG. 2 is a perspective view illustrating the inside of a refrigerator according to an embodiment of the present invention;

FIG. 3 is a perspective view illustrating a withdrawal device according to an embodiment of the present invention;

FIG. 4 is an exploded perspective view illustrating the withdrawal device of FIG. 3;

FIG. 5 is a perspective view illustrating an outer cover constituting a withdrawal device according to an embodiment of the present invention;

FIG. 6 is a perspective view illustrating a slide member constituting a withdrawal device according to an embodiment of the present invention;

FIG. 7 is a perspective view illustrating an inner cover constituting a withdrawal device according to an embodiment of the present invention;

FIG. 8 is a longitudinally-sectional view taken along the line VIII-VIII of FIG. 3;

FIG. 9 is a perspective view illustrating a connector constituting a withdrawal device and connected to a slide member according to an embodiment of the present invention;

FIG. 10 is a view illustrating a shelf mounted with a receiver which a connector is fitted into;

FIG. 11 is a longitudinally-sectional view taken along the line XI-XI of FIG. 3;

FIG. 12 is an exploded perspective view illustrating another exemplary connection member of a withdrawal device according to an embodiment of the present invention;

FIG. 13 is a view illustrating a coupling process of a connection member according to another embodiment of the present invention;

FIG. 14 is a plan view illustrating a linkage with a withdrawal device when a door is closed; and FIGS. 15 and 16 are plan views illustrating the movement of a withdrawal device according to the open degree of a door.

BEST MODE

The foregoing and other objects, features, aspects and advantages of the present invention will become more apparent from the following detailed description of the present invention when taken in conjunction with the accompanying drawings. Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Hereinafter, a refrigerator according to an embodiment of the present invention will be described in detail with reference to the accompanying drawings.

FIG. 1 is a perspective view illustrating a refrigerator according to an embodiment of the present invention. FIG. 2 is a perspective view illustrating the inside of a refrigerator according to an embodiment of the present invention;

Referring to FIGS. 1 and 2, a refrigerator 10 according to an embodiment of the present invention may include a cabinet 11 defining the exterior and forming an internal storage space, and doors pivotably or slidably disposed on the front face of the cabinet 11 and selectively opening/closing the storage space.

Specifically, the storage space may include a refrigerating compartment 111 provided to keep foods refrigerated and a freezing compartment 112 provided to keep foods frozen. The refrigerating compartment 111 may be disposed at the upper side, lower side, or lateral side of the freezing compartment 112. In this embodiment, the refrigerator will be exemplified as a bottom freezer type of refrigerator in which the refrigerating compartment 111 is separated from the freezing compartment 112 by a mullion 113 and the refrigerating compartment 111 is disposed over the freezing compartment 112.

Also, the door may include a refrigerating compartment door 12 for opening/closing at least a portion of the refrigerating compartment 111 and a freezing compartment door 13 for opening/closing at least a portion of the freezing compartment 112. Specifically, the refrigerating compartment door 12 may include a single pivotable door pivotably provided on the lateral edge of the front face of the cabinet 11, or a French door pivotably provided on the left lateral edge and the right lateral edge of the front face of the cabinet 11 to open/close the front face opening of the refrigerating compartment 111. In this embodiment, the refrigerating compartment door 12 will be exemplified as a French door type. Also, the freezing compartment door 13 may be provided as a French door type like the refrigerating compartment door 12, or may be provided as a drawer type.

The pair of refrigerating compartment doors 12 may be pivotably connected to the front face of the cabinet 11 by a hinge assembly. Here, one of the refrigerator compartment door 12 or each of the refrigerating compartment doors 12 may be divided into two doors in forward and backward directions.

Specifically, at least one of the pair of refrigerating compartment doors 12 may include an inner door pivotably connected to the lateral edge of the front surface portion of the cabinet 11 by a hinge mechanism and closing substantially the half of the front face opening of the refrigerating compartment 111, and an outer door disposed at the front side of the inner door and pivotably connected to the inner door by a separate hinge mechanism.

When the outer door pivots to be separated from the front surface of the inner door, the front surface of the inner door may be exposed to the outside. Also, when the inner door pivots, the front face of the cabinet 11 may be opened. The pivoting direction of the outer door for opening the front face of the inner door may be the same as the pivoting direction of the inner door for opening the front face of the cabinet 11.

Also, the inner door may have an access opening formed therein. Also, a plurality of storage members including a shelf or basket may be arranged along a vertical direction in the access opening. A storage case 121 defining a sub storage compartment may be mounted onto the rear surface of the inner door. In this structure, when the inner door is closed and the outer door is opened, foods may be withdrawn from or stored in the sub storage compartment through the access opening.

Meanwhile, a plurality storage boxes 115 and a plurality of shelf assemblies 20 may be disposed in the refrigerating compartment 111. Specifically, the plurality of storage boxes 115 may be parallelly disposed at the left side and the right side of the refrigerating compartment 111, respectively, and may be arranged along a vertical direction. Also, the plurality of shelf assemblies 20 may be parallelly disposed at the left side and the right side of the refrigerating compartment 111, respectively, and may be arranged along a vertical direction.

The cabinet 11 may include an inner case 117 defining the refrigerating compartment 111 and the freezing compartment 112, an outer case 116 covering the outer side of the inner case 117 and defining the exterior of the cabinet 11, and an insulating material (see 118 of FIG. 8) filled between the inner case 117 and the outer case 116.

Also, the shelf assembly 20 may include a shelf supporting arm 21 fixed to the rear surface of the inner case 117 and having a cantilever shape, and a shelf which is seated on the top surface of the shelf supporting arm 21 and configured to be slidably moved in forward and backward directions along the shelf supporting arm 21.

Accordingly, the refrigerating compartment door 12 at the left side may be opened to withdraw foods stored in the storage box 115 and the shelf assembly 20 which are disposed at the left side, and the refrigerating compartment door 12 at the right side may be opened to withdraw foods stored in the storage box 115 and the shelf assembly 20 which are disposed at the right side.

In this embodiment, when one of the left and right refrigerating compartment doors is opened, the shelf assembly 20 disposed at the rear side of the corresponding refrigerating compartment door may move to the front side of the refrigerating compartment 111.

Hereinafter, a withdrawal device which performs the above-mentioned function will be described in detail with reference to the accompanying drawings.

FIG. 3 is a perspective view illustrating a withdrawal device according to an embodiment of the present invention, and FIG. 4 is an exploded perspective view illustrating the withdrawal device of FIG. 3.

Referring to FIGS. 3 and 4, a withdrawal device 30 according to an embodiment of the present invention may withdraw the shelf 22 of the shelf assembly 20 forward when the door 12 is opened, and may lead the shelf 22 into the inside of the compartment 111 when the door 12 is closed.

Specifically, the shelf assembly 20 may be fixed to a pair of support frames 201 vertically disposed on the rear surface of the refrigerating compartment 111. The shelf supporting arm 21 may include stopping hooks protruding from the left and right rear end portions thereof, and the stopping hooks may be inserted into stopping hole formed in the pair of support frames 201. The shelf 22 may be coupled to the shelf supporting arm 21 so as to slidably move on the shelf supporting arm 21 in forward and backward directions.

Also, the withdrawal device 30 may include an inner cover 34, an outer cover 32, a slide member 33, a link member 31, and a connection member. The inner cover 34 may form a portion of the side surface of the refrigerating compartment 111, i.e., a portion of the inner case 117. The outer cover 32 may be coupled to the inner cover 34 at the opposite side to the inner cover 34. The slide member 33 may be disposed between the inner cover 34 and the outer cover 32, and may move in forward and backward directions of the refrigerator 10. The link member 31 may connect the top surface of the slide member 33 and the top surface of the door 12. The connection member may connect the side surface of the shelf 12 and the slide member 33. The connection member may include a connector 35 mounted on the slide member 33, and a receiver 36 detachably coupled to the side surface of the shelf and receiving the connector 35.

Specifically, when the door 12 is opened, the link member 31 may move forward while pivoting on the rotation center of the door 12. Consequently, the slide member 33 connected to the rear end of the link member 31 may move to the front side of the refrigerator 10. As the slide member 33 moves forward, the shelf 22 connected to the slide member 33 by the connection member may also move forward.

The outer cover 32 and the slide member 33 may be placed between the inner case 117 and the outer case 116, and may be prevented from wobbling as surrounded by the insulating material 118. Also, since the slide member 33 is disposed at the outer side of the inner case 34, the slide member 33 may not be exposed to the outside even when the door 12 is opened and thus the refrigerating compartment 111 is opened.

Hereinafter, components of the withdrawal device will be described in more detail with reference to the accompanying drawings.

FIG. 5 is a perspective view illustrating an outer cover constituting a withdrawal device according to an embodiment of the present invention.

Referring to FIG. 5, the outer cover 32 constituting the withdrawal device 30 may have a rectangular plate shape with a certain width W, and four edges thereof may be bent at a right angle, thereby the thickness of the outer cover 32 is defined. Also, a plurality of coupling parts 323 may be formed on the edge of the outer cover 32 which is bent.

Also, a plurality of coupling bosses 322 may protrude from the center of the inner surface of the outer cover 32, and may be disposed to be spaced from each other by a certain distance in a longitudinal direction of the outer cover 32.

Also, a plurality of guide grooves 321 may be formed in the outer cover 32, and may extend in a width direction of the outer cover 32 by a certain length. The guide grooves 321 may be disposed so as to be spaced from each other by a certain distance in a longitudinal direction of the outer cover 32.

FIG. 6 is a perspective view illustrating a slide member constituting a withdrawal device according to an embodiment of the present invention.

Referring to FIG. 6, the slide member 33 constituting the withdrawal device 30 may have a substantially rectangular shape.

Specifically, the slide member 33 may include an outer surface 336 facing the outer cover 32, an inner surface (see FIG. 9) facing the inner cover 34 and opposite to the outer surface 336, a front end portion 331 facing the front surface of the refrigerator 11, a rear end portion 332 defining the opposite side of the front end portion 331, an upper end portion 333 connecting the top surfaces of the front end portion 331 and the rear end portion 332, a lower end portion 334 connecting the bottom surfaces of the front end portion 331 and the rear end portion 332, a link connection end 337 horizontally protruding from the upper end portion 333, and a link connection boss 338 protruding from the top surface of the link connection end 337.

Also, a plurality of guide ribs 330*b* may protrude from the outer surface of the slide member 33 to guide the forward and backward movement of the slide member 33, and a plurality of spacing ribs 330*a* may protrude from the outer surface of the slide member 33 so as to space the outer cover 32 from the slide member 33 by a certain gap.

The guide rib 330*b* may protrude at a location corresponding to the guide groove formed in the outer cover 32, and may be inserted into the guide groove 321 to move in forward and backward directions.

The guide groove 321 may be recessed from the inner surface of the outer cover 32 and the outer surface of the outer cover 32 has a protruded portion corresponding to the guide groove 321. The vertical width (or thickness) of the guide groove 321 may be formed so as to correspond to the thickness of the guide rib 330*b*. Thus, as the guide rib 330*b* moves along the guide groove 321, the slide member 33 may be prevented from wobbling when the slide member 33 moves.

FIG. 7 is a perspective view illustrating an inner cover constituting a withdrawal device according to an embodiment of the present invention.

Referring to FIG. 7, the inner cover 34 constituting the withdrawal device 30 may include a cover body 345 having a rectangular plate shape of a size corresponding to the outer cover 32, and a link inner cover part 343 horizontally extending from the upper end of the cover body 345.

Specifically, the inner cover 34 may further include an edge part 346 outwardly bent at the edge of the cover body 345. Also, a plurality of coupling holes 344 may be formed in the edge part 346. The coupling parts 323 formed on the edge part of the outer cover 32 may be inserted into the coupling holes 344, and thus the inner cover 34 and the outer cover 32 may be coupled into one body.

Also, a plurality of coupling holes 342 may be formed in the central portion of the cover body 345, and the plurality of coupling holes 342 may be disposed at a uniform interval in a longitudinal direction of the cover body 345. The coupling bosses 322 protruding from the outer cover 32 may be pressed to around the plurality of the coupling holes 342, respectively. A coupling member penetrating the coupling hole 342 may be inserted into the coupling boss 322, and thus the inner cover 34 and the outer cover 32 may be coupled into one body. The cover body 345 of the inner cover 34 and the outer cover 32 may be spaced from each other by the protruding length of the coupling boss 322, and thus may form an internal space for receiving the slide member 33.

Also, a plurality of guide slits 341 corresponding to the number of the shelves 22 may be formed on the cover body 345.

Specifically, the guide slit 341 may correspond to a movement hole into which the connector 35 is fitted, and may be formed on a location corresponding to the side surface of the shelf assembly 20. Accordingly, even though the shelf 22 move in forward and backward directions, the guide slit 341 may not be exposed to the outside due to the shelf guide 21.

Also, the link inner cover part 343 may define a space for receiving the link member 31, and may perform a function of covering the link member 31 such that the link member 31 is not exposed to the inside of the refrigerating compartment 111.

Specifically, the link inner cover part 343 may include a horizontal part horizontally extending from the upper end of the cover body 345 and a vertical part upwardly extending from the edge of the horizontal part. The vertical part may include a front surface wall 343*a*, a side surface wall 343*b*, and a rear surface wall 343*c*, and the end portions of the walls 343*a*, 343*b* and 343*c* constituting the vertical part may contact with the ceiling of the refrigerating compartment 111, i.e., the upper surface of the inner case 117. A link through hole 343*d* that the link member 31 penetrates may be fanned in the front surface wall 343*a*. Accordingly, other portions of the link member 31 except a portion of the link member 31 protruding to the front side through the link through hole 343*d* may be covered by the link inner cover part 343, and thus may not be exposed to the outside.

Here, the inner case 117 may substitute for the cover body 345, and only the link inner cover part 343 may also be provided so as to connect the ceiling portion and the upper portion of the inner case 117. Then, the guide slit 341 may be formed on the inner case 117. Also, the outer cover 32 may be directly connected to the inner case 117.

FIG. 8 is a longitudinally-sectional view taken along the line VIII-VIII of FIG. 3.

Referring to FIG. 8, the inner cover 34 may form a portion of the inner case 117, and the link inner cover part 343 may be fixed to the ceiling of the inner case 117.

Specifically, the outer cover 32 may be fixedly coupled to the inner cover 34. The slide member 33 may be held in the space defined by the inner cover 34 and the outer cover 32.

Also, the guide rib 330*b* horizontally protruding from the outer surface of the slide member 33 may be inserted into the guide groove 321 formed in the outer cover 32. Simultaneously, the inner surface 335 of the slide member 33 may contact with the cover body 345 of the inner cover 34, and the spacing rib 330*a* may adhere closely to the outer cover 32. Accordingly, the slide member 33 may be moved in forward and backward directions by the link member while maintaining the stable state without wobbling from side to side.

Since the insulating material 118 covers the outer surface of the outer case 32 while being filled in the space between the inner case 117 and the outer case 116, the outer cover 32 may be fixed without wobbling.

FIG. 9 is a perspective view illustrating a connector constituting a withdrawal device and connected to a slide member according to an embodiment of the present invention. FIG. 10 is a view illustrating a shelf mounted with a receiver which a connector is fitted into.

Referring to FIG. 9, a connector boss 339 may protrude at the edge of the front end portion of the inner surface of the slide member 33, and a fixing groove 339*a* may be concavely formed in the inner surface of the slide member 33 corresponding to the edge of the connector boss 339.

Also, the connector 35 constituting the connection member connecting the slide member 33 and the shelf 22 may be coupled to the connector boss 339 by a fitting method. Specifically, the connector 35 may include a separation preventing plate 351, a connecting sleeve 352, and a pair of fixing protrusions 353.

More specifically, the connecting sleeve 352 may have a hollow cylindrical shape, and the connector boss 339 may be inserted into the connecting sleeve 352.

The separation preventing plate 351 may extend outwardly from one end portion of the connecting sleeve 352 in a radial direction, and may extend so as to have a width larger than the outer diameter of the connecting sleeve 352.

The pair of fixing protrusions 353 may further protrude from the other end portion of the connecting sleeve 352, and may be formed at opposite points to each other on a diameter of the connecting sleeve 352. When the connector 35 is coupled to the connector boss 339, the fixing protrusions 353 may be inserted into the fixing groove 339*a*, thereby preventing the connector 35 from ineffectively spinning by an external force.

The connector 35 and the connector boss 39 may be provided in plurality on points corresponding to the location of the shelf assemblies 20 in accordance with the number of the shelf assemblies 20.

Referring to FIG. 10, the separation preventing plate 351 of the connector 35 may be inserted into the receiver 36 mounted on the side surface of the shelf 22.

Specifically, the receiver 36 may be detachably coupled to the side surface of the shelf 22. The shelf 22 may include a shelf glass 222 and a shelf frame 221 surrounding the edge of the shelf glass 222, and the receiver 36 may be mounted onto the shelf frame 221. Since the receiver 36 is easily attached to and detached from the shelf 22, a user only needs to separate the receiver 36 when he/she does not desire the automatic withdrawal function of the shelf 22. Accordingly, a user can selectively use the automatic withdrawal function of the shelf 22.

The receiver 36 may include a first surface portion 361, a second surface portion 362 which is spaced apart from the first surface portion 361 and provides a receiving space between the first and second surface portions 361, 362. The receiver 36 may further include a third surface portion 363 bent along an edge of the first surface portion 361, except a lower section of the edge of the first surface portion 361 such that an insertion hole 365 may be formed on a lower side surface of the receiver 36, and connect the first and second surface portions 361, 362.

Specifically, the first surface portion 361 and the second surface portion 362 may be spaced from each other by the width of the third surface portion 363, thereby forming the receiving space therebetween. The separation preventing plate 351 of the connector 35 may be inserted into the receiving space. That is, the thickness of the receiving space defined by the first surface portion 361 and the second surface portion 362 may correspond to the thickness of the separation preventing plate 351.

The third surface portion 363 may include upper, front and rear side surface portions, and a pair of flanges 364 may extend from the front and rear side surface portions, respectively. A coupling member may be inserted into the shelf frame 221 through the coupling flange 364, and thus the receiver 36 may be coupled to the shelf 22. When a user does not desire the automatic withdrawal function, the receiver 36 may be separated from the shelf 22.

Meanwhile, the insertion hole 365 may be formed on a lower side surface of the receiver 36, and thus the separation preventing plate 351 of the connector 35 may be inserted into the insertion hole 365. A fitting groove 367 may be concavely formed from the lower side to the upper side of the first surface portion 361 of the receiver 36. The fitting groove 367 may have an inclined or rounded guide inclination surface 366, the width of which gradually decreases from the lower side to the upper side. The connecting sleeve 352 of the connector 35 may be inserted into the fitting groove 367, and the guide inclination surface 366 may allow the connecting sleeve 352 to be smoothly inserted into the fitting groove 367.

Specifically, the fitting groove 367 may be formed to have a circular arc shape having a diameter corresponding to the outer diameter of the connecting sleeve 352. The lower side portion of the fitting groove 367 may be connected to the guide inclination surface 366. Also, the width of the upper end portion of the guide inclination surface 366 may have a size corresponding to the outer diameter of the connecting sleeve 353, and the width of the lower end portion of the guide inclination surface 366 may be formed to have a larger width than the width of the upper end portion of the guide inclination surface 366. Accordingly, even though the connecting sleeve 352 is not accurately located under the fitting groove 367, the connecting sleeve 352 can be accurately inserted into the fitting groove 367 along the guide inclination surface 366.

FIG. 11 is a longitudinally-sectional view taken along the line XI-XI of FIG. 3.

Referring to FIG. 11, the connector 35 may be fitted into the connector boss 339 disposed on the inner side surface of the slide member 33. Also, the separation preventing plate 351 of the connector 35 may be fitted into the fitting groove 367 of the receiver 36, and thus the connector 35 may be prevented from being separated from the receiver 36 while the shelf 22 is moving in forward and backward directions. In other words, the separation preventing plate 351 may extend in a direction orthogonal to the connecting sleeve 352, and simultaneously may be formed to be larger than the outer diameter of the connecting sleeve 352. Accordingly, when the separation preventing plate 351 is inserted into the insertion hole 365 formed on the bottom surface of the receiver 36, the separation preventing plate 351 may be stopped by the front surface portion 361 of the receiver 36. Then, even though the shelf 22 wobbles from side to side while moving in forward and backward directions, the connector 35 may be prevented from being separated from the receiver 36.

More specifically, in the process where the connector 35 is fitted into the receiver 36, the door 12 may be opened such that the link member 31 is allowed to move to the front side of the cabinet 11 to the maximum. Then, the slide member 33 connected to the link member 31 may also be moved to the front side of the cabinet 11 to the maximum.

At this point, a user may pull the shelf 22 forward such that the shelf 22 moves forward along the shelf supporting arm. When the receiver 36 reaches a location close to the connector 35, the front end portion of the shelf 22 may be slightly lifted. When the front end portion of the shelf 22 is slightly lifted, the shelf 22 may be further pulled forward such that the receiver 36 is located directly over the connector 35. In this state, when the front end portion of the shelf 22 is put down, the separation preventing plate 351 and the connecting sleeve 352 of the connector 35 may be inserted into the receiver 36.

Meanwhile, when the door 12 is closed while the connector 35 is inserted into the receiver 36, the slide member 33 and the shelf 22 may together move backward.

FIG. 12 is an exploded perspective view illustrating another exemplary connection member of a withdrawal device according to an embodiment of the present invention. FIG. 13 is a view illustrating a coupling process of a connection member according to another embodiment of the present invention.

Referring to FIG. 12, a connector 35 constituting the connection member according to another embodiment of the present invention may be similar to the connector according to the previous embodiment except that the separation preventing plate thereof has a rounded shape instead of a polygonal shape.

Specifically, the separation preventing plate 351 of the connector 35 may have a circular or oval shape.

Also, the shape of the receiver 36 which the connector 35 is inserted may be substantially identical to the shape of the receiver 36 according to the previous embodiment except that a side surface portion 363 facing the connector 35 has a smoothly rounded or inclined shape when the shelf 22 is withdrawn forward.

More specifically, the side surface portion which faces the connector 35 may be a front side surface portion 363 among the upper and lower side surface portions and the front and rear side surface portions of the receiver 36. The front side surface portion 363, as shown in FIG. 12, may be formed to have a smoothly rounded shape from the upper end to the lower end thereof. That is, the front surface portion 363 may be rounded such that the front-to-rear width of the surface portion 361 may gradually decrease from the upper side to the lower side thereof.

Referring to FIGS. 13A to 13C, in order to couple the connector 35 to the receiver 36, a user may open the door 12 such that the connector 35 is located at the frontmost side. In this state, the shelf 22 may be allowed to be slidably withdrawn forward along the shelf supporting arm 21. In this case, the front end portion of the shelf 22 need not be lifted.

Specifically, when the shelf 22 is horizontally withdrawn forward, the rounded side surface portion 363 of the receiver 36 may make contact with the separation preventing plate 351 of the connector 35. In this state, when the shelf 22 is further withdrawn forward, the separation preventing plate 351 may relatively move along the rounded side surface portion 363 of the receiver 36. Then, the shelf 22 may be upwardly lifted, and when the separation preventing plate 351 is inserted into the insertion hole 365 formed on the bottom surface of the receiver 36, the shelf 22 may again descend and become horizontal. Also, the connector 35 may become fully fitted into the receiver 36.

Thus, since the side surface portion 363 of the receiver 36 making contact with the separation preventing plate 351 is formed to be smoothly rounded, a user need not intentionally lift up and put down the shelf 22 in order to insert the connector 35 into the receiver 36.

FIG. 14 is a plan view illustrating a linkage with a withdrawal device when a door is closed.

Referring to FIG. 14, when the door 12 is closed, the rear end portion 312 of the link 34 may be located at a point where the dotted line al passes. In this state, the shelf 22 may be maintained at a state where the shelf 22 is completely inserted into the refrigerating compartment 111.

Also, when the door 12 pivots clockwise, the front end portion 311 of the link member 31 may move along the circumference T having a radius R around a hinge axis 123 which is the center of rotation of the door 12. The hinge axis 123 may be formed at the front end portion of the hinge bracket 122, and the rear end portion of the hinge bracket 122 may be fixed to the upper surface of the cabinet 11. Also, the hinge axis 123 may be inserted into the edge of the upper surface of the door 12.

FIGS. 15 and 16 are plan views illustrating the movement of a withdrawal device according to the open degree of a door.

Referring to FIG. 15, when the door 12 pivots and opens by a first preset angle θ1, the rear end portion 312 of the link member 31 may move forward from the initial point where the dotted line a1 is located to a point where the dotted line a2 passes. The forward movement of the rear end portion of the link member 31 may mean the forward movement of the shelf 22. In this case, the front end portion of the link member 31 may move forward while rotating along the circumference T.

Referring to FIG. 16, when the door 12 further pivot and opens by a second preset angle θ2 from the state of FIG. 15, the front end portion of the link member 31 may move forward to a point farthest from the front face of the cabinet 11. In this case, the shelf 22 may be withdrawn forward to the maximum, and the front end portion of the shelf 22 may be placed on the same plane as the front face of the cabinet 11, or may be placed on the slightly rear side of the front face of the cabinet 11. On the other hand, according to the design conditions, the front end portion of the shelf 22 may further protrude from the front face of the cabinet 11. However, in order to minimize the interference limitation with a user, it may be desirable that the front end portion of the shelf 22 is withdrawn only to the front face of the cabinet 11.

In this state, when the door 12 further pivots, the shelf 22 may move in a backward direction, which can be easily understood when the front end portion 311 of the link member 31 moves along the circumference T.

The invention claimed is:

1. A refrigerator comprising:

a cabinet comprising an outer case, an inner case disposed inside the outer case and defining a storage space, and an insulating material filled between the outer case and the inner case;

a door pivotably connected to a front surface of the cabinet and selectively opening/closing a storage compartment;

a shelf assembly comprising a shelf supporting aim fixed to a rear surface of the inner case and a shelf connected to the shelf supporting arm so as to be slidably movable; and a withdrawal device connected to the door and withdrawing the shelf forward in accordance with pivoting of the door for opening the storage space, wherein the withdrawal device comprises:

a slide member held in a space between the outer case and the inner case;

a link member comprising a front end portion connected to the door and a rear end portion connected to the slide member; and a connection member connecting the slide member and the shelf.

2. The refrigerator of claim 1, wherein the connection member comprises:

a connector mounted onto the slide member; and a receiver mounted onto a side surface of the shelf and receiving the connector.

3. The refrigerator of claim 2, wherein the inner case comprises a guide slit formed at a point corresponding to the location of the shelf and extending in forward and backward directions by a certain length, and the connector is coupled to the receiver through the guide slit.

4. The refrigerator of claim 2, wherein the front end portion of the link member is located at a point spaced from a rotation axis of the door by a certain distance.

5. The refrigerator of claim 2, further comprising a link cover disposed around a ceiling of the inner case to block the link member from being exposed to the inside of the storage compartment.

6. The refrigerator of claim 2, further comprising an outer cover disposed between the inner case and the outer case and covering the slide member.

7. The refrigerator of claim 6, further comprising:

at least one guide rib protruding from the other surface opposite to one surface of the slide member to which the connector is connected and extending in a width direction of the slide member by a certain length; and a guide groove concavely formed in the outer cover and receiving the guide rib.

8. The refrigerator of claim 7, further comprising at least one spacing rib disposed at locations vertically spaced from the guide rib and protruding and extending parallelly to the guide rib.

9. The refrigerator of claim 3, wherein the connector comprises:

a connecting sleeve fixed to the slide member and penetrating the guide slit; and a separation preventing plate extending orthogonally to the connecting sleeve from an end portion of the connecting sleeve, wherein the separation preventing plate is inserted into the receiver.

10. The refrigerator of claim 9, wherein the receiver comprises:

a first surface portion;

a second surface portion which is spaced apart from the first surface portion and provides a receiving space between the first and second surface portions; and a third surface portion connecting the edges of the first and second surface portions, except lower sections of the edges of the first and second surface portions such that an insertion hole for receiving the separation preventing plate is formed on a lower side surface of the receiver, wherein:

a fitting groove into which the connecting sleeve is fitted is fat lied at the first surface portion; and the fitting groove is upwardly recessed from a lower end of the first surface portion.

11. The refrigerator of claim 10, wherein a front surface of the third surface portion which faces a front end of the shelf is rounded, and the front-to-rear width of the front surface of the third surface portion gradually decreases from an upper side to a lower side.

12. The refrigerator of claim 2, wherein the receiver is detachably coupled to the shelf.

* * * * *